US011565376B2

(12) United States Patent
Li

(10) Patent No.: US 11,565,376 B2
(45) Date of Patent: Jan. 31, 2023

(54) WOODWORKING VISE

(71) Applicants: Hangzhou United Tools Co., Ltd., Hangzhou (CN); Hangzhou Great Star Industrial Co., Ltd., Hangzhou (CN)

(72) Inventor: Yueming Li, Hangzhou (CN)

(73) Assignees: Hangzhou United Tools Co., Ltd., Hangzhou (CN); Hangzhou Great Star Industrial Co., Ltd., Hangzhou (CN)

( * ) Notice: Subject to any disclaimer, the term of this patent is extended or adjusted under 35 U.S.C. 154(b) by 0 days.

(21) Appl. No.: 17/829,808

(22) Filed: Jun. 1, 2022

(65) Prior Publication Data

US 2022/0288748 A1 Sep. 15, 2022

Related U.S. Application Data

(63) Continuation of application No. 17/772,439, filed as application No. PCT/CN2019/113594 on Oct. 28, 2019.

(51) Int. Cl.

| | |
|---|---|
| ***B25B 1/08*** | (2006.01) |
| ***B25B 1/02*** | (2006.01) |
| ***B25B 1/24*** | (2006.01) |

(52) U.S. Cl.

CPC ..... *B25B 1/08* (2013.01); *B25B 1/02* (2013.01); *B25B 1/2489* (2013.01)

(58) Field of Classification Search

CPC .. B25B 5/085; B25B 5/08; B25B 5/16; B25B 1/02; B25B 1/08; B25B 1/2489; F16B 2/12

See application file for complete search history.

(56) References Cited

U.S. PATENT DOCUMENTS 5,348,276 A * 9/1994 Blacker ..... B25B 5/085 269/169

7,661,181 B1 2/2010 Whitfield (Continued)

FOREIGN PATENT DOCUMENTS

CN 104249314 A 12/2014

CN 207172313 U 4/2018

(Continued)

*Primary Examiner* — Seahee Hong

(74) *Attorney, Agent, or Firm* — Blank Rome LLP

(57) ABSTRACT

A woodworking vise includes a profiled vise body (1), a first jaw (2) and a second jaw (2'). The first jaw (2) and the second jaw (2') are disposed at both ends of the vise body along its longitudinal axis. The woodworking vise further includes at least one movable jaw (3). The at least one movable jaw (3) is slidably connected to a top surface of the profiled vise body. Between the movable jaw (3) and the top surface of the profiled vise body (1), a locking block (36) is disposed, and a bottom surface of the locking block (36) is slidably connected to the top surface of the profiled vise body (1). The movable jaw (3) includes a force applying means (34) and a camshaft (35). The camshaft (35) has at least one cam, and the force applying means (34) is connected to the camshaft (35). Moreover, the force applying means (34) is able to rotate about a center axis of the camshaft (35) to drive the camshaft (35) to rotate therewith to cause the cam of the camshaft (35) to press against the locking block (36) and, by means of the locking block (36), press and secure the movable jaw (3) against and to the top surface of the vise body (1). Wherein, the center axis of the camshaft (35) is perpendicular to the longitudinal axis of the profiled vise body (1). This woodworking vise can solve the problem of an angle of clamping deviation.

16 Claims, 11 Drawing Sheets

(56) References Cited

U.S. PATENT DOCUMENTS

| | | | | |
|---|---|---|---|---|
| 8,177,209 | B2 * | 5/2012 | Chen | B25B 5/08 269/95 |
| 10,751,856 | B2 * | 8/2020 | Emerson | B25B 1/2489 |
| 2015/0283679 | A1 * | 10/2015 | Ursell | B25B 5/085 269/147 |
| 2018/0141195 | A1 * | 5/2018 | Huang | B25B 5/085 |

FOREIGN PATENT DOCUMENTS

| | | | |
|---|---|---|---|
| CN | 108673659 | A | 10/2018 |
| CN | 208744613 | U | 4/2019 |
| CN | 209175925 | U | 7/2019 |
| KR | 10-0780388 | B1 | 11/2007 |
| TW | M-576097 | U | 4/2019 |

* cited by examiner

WOODWORKING VISE

RELATED APPLICATIONS

The present application is a continuation application of U.S. patent application Ser. No. 17/772,439, filed on Apr. 27, 2022, which is a national phase application of International Application No. PCT/CN2019/113594, filed on Oct. 28, 2019. The entire contents of these applications are incorporated herein by reference.

FIELD OF THE INVENTION

This application relates to the technical field of vises and, in particular, to a woodworking vise.

DESCRIPTION OF THE PRIOR ART

Woodworking vises are commonly used clamping devices on workbenches for fixing workpieces to facilitate their processing. For workpiece of different lengths, vises of different sizes are typically used.

In the prior art, there is a vise capable of adjusting its clamping length. For example, as shown in the patent CN208744613, the vise includes a vise body, a fixed jaw fixed to the vise body, and a movable jaw assembly movably connected to the vise body and movable along the vise body. The vise body is made up of at least two vise body segments that are put together. The vise body segments that are put together are connected by a vise body connecting means. The vise body is made up of at least two vise body segments that are put together, and the vise body segments, after being put together, can extend an overall length of the vise body. After the vise body segments are put together, a position of the fixed jaw on the vise body may experience changes. That is, if the movable jaw assembly does not move, a distance between the fixed jaw and the movable jaw assembly will expand, resulting in an increase in a maximum clamping distance between the fixed jaw and the movable jaw assembly.

The movable jaw assembly includes a jaw fixing frame assembled with the vise body segments, a cam-type rotating clamping means disposed on the jaw fixing frame, a handle for manipulating the rotating clamping means and movable dies connected to the jaw fixing frame. The cam-type rotating clamping means includes a clamping pad and a pin shaft in cooperation with the clamping pad. The clamping pad is arranged at middle of the jaw fixing frame and provided with a guide hole, and the jaw fixing frame is provided with a guide pole. The guide pole is inserted in the guide hole. Under the guidance of the guide pole and the guide hole, the clamping pad can move relative to the jaw fixing frame. The clamping pad is provided at the bottom with a depression. The depression cooperates with a raised portion of the vise body segments. The presence of the depression maximizes a vertical thickness of the clamping pad. The clamping pad is brought into contact with the bottom of a guide means.

After a workpiece is placed on a top surface of the vise body, the movable jaw assembly is moved to clamp the workpiece, and the handle of the movable jaw assembly is rotated to fix the movable jaw assembly to the vise body. Since the direction of a force that rotates the handle always forms a certain angle with the direction of a longitudinal axis of the vise body, meaning that there is a stress directed toward the left or right relative to the longitudinal axis of the vise body, i.e., the direction of the force that rotates the handle forms an angle with a straight line direction of guide rails, as such, after the workpiece is clamped between clamping surfaces, a deviation of the workpiece from the straight line direction of the guide rails may be caused, creating an angle of clamping deviation, i.e., there is an angle of deviation between the workpiece and the straight line direction of the guide rails, leading to unsuitability for processing or non-precise processing.

Therefore, those skilled in the art are directing their effort toward developing a woodworking vise and how to avoid the problem of a deviation from a straight line direction of guide rails after clamping by clamping surfaces causing an angle of clamping deviation.

SUMMARY OF THE INVENTION

In view of the above described shortcomings of the prior art, the technical problem to be addressed by the present application is the existence of the technical problem of a deviation from a straight line direction of guide rails after clamping by clamping surfaces.

One aspect of this application proposes a woodworking vise comprising a vise body, a first jaw and a second jaw, wherein the first jaw and the second jaw are disposed at both ends of the vise body along a longitudinal axis thereof;

the woodworking vise further comprises at least one movable jaw, the at least one movable jaw slidably connected to a top surface of the vise body;

between the movable jaw and the top surface of the vise body, a locking block is disposed, and a bottom surface of the locking block is slidably connected to the top surface of the vise body;

the movable jaw comprises a force applying means and a camshaft, the camshaft having at least one cam, the force applying means connected to the camshaft, the force applying means able to rotate about a center axis of the camshaft to drive the camshaft to rotate therewith to cause the cam of the camshaft to press against the locking block and by means of the locking block, press and fix the movable jaw against and to the top surface of the vise body, wherein the center axis of the camshaft is perpendicular to the longitudinal axis of the vise body.

Optionally, at least one of the first jaw and the second jaw is movably connected to the vise body.

Optionally, the woodworking vise further comprises at least one connecting member, the vise body is provided with a plurality of coupling holes arranged along the longitudinal axis of the vise body, when the first jaw and/or the second jaw is/are moved to a predetermined position, the connecting member fixes the first jaw and/or the second jaw at the predetermined position by means of the coupling holes.

Optionally, the connecting member is a screw or a bolt.

Optionally, at least one of the first jaw and the second jaw is a fixed jaw fixedly connected to the vise body.

Optionally, the vise body is provided with channel rails along its longitudinal axis, the movable jaw is provided on its bottom surface with slide brackets in cooperation with the channel rails, the movable jaw is slidable forth and back on the top surface of the vise body by virtue of the channel rails and the slide brackets.

Optionally, the movable jaw further comprises a die fixing frame, a first movable die and a second movable die;

the die fixing frame is provided with openings on both ends along the longitudinal axis of the vise body, the first movable die and the second movable die are inserted respectively into the openings at both ends of the die fixing frame, and end side surfaces of the openings of the die fixing frame into which the first movable die and the second movable die are inserted are die thrust surfaces.

Optionally, the vise body is provided with channel rails along its longitudinal axis, and the first movable die and the second movable die are both provided on their bottom surfaces with slide brackets in cooperation with the channel rails.

Optionally, the camshaft defines a first cam at the middle and a second cam on both sides, the first cam raised over the second cam;

a surface of the first cam contacts a top surface of the locking block, a surface of the second cam contacts respectively the die thrust surfaces of the first movable die and the second movable die.

Optionally, the movable jaw further includes a first die pad and a second die pad, the first die pad and the second die pad connected to outermost ends of the first movable die and the second movable die along the longitudinal axis of the vise body, respectively.

Optionally, the vise body is provided with channel rails along its longitudinal axis, and the first die pad and the second die pad are both provided at their bottom surfaces with slide brackets in cooperation with the channel rails.

Optionally, the first movable die and the second movable die have, on their surfaces, limiting ribs, the limiting ribs used to respectively limit the first movable die and the second movable die from complete insertion into the openings of the die fixing frame.

Optionally, the force applying means includes a grip and a shaft, the shaft passed along the center axis of the camshaft and fixed to the camshaft, the shaft then fixed further to the grip.

Optionally, the movable jaw is provided with limiting ribs, and the force applying means has limiting grooves cooperating with the limiting rib to rotate the force applying means to a predetermined position.

Optionally, the grip is fixed to the shaft by a pin, a screw or a bolt.

Optionally, the bottom surface of the locking block is fixedly connected to a locking gasket, and a bottom surface of the locking gasket is slidably connected to the top surface of the vise body.

Optionally, the vise body comprises two separable vise body segments and a connecting member connecting the two vise body segments, the two vise body segments able to be nested together with one being partially overlapped or superimposed with the other.

Optionally, the camshaft may be a non-circular camshaft, which has at least one cam.

Optionally, the cam has, at the top, a fixation surface in cooperation with a surface of the locking block.

Optionally, the fixation surface is wavy or curved in shape.

Optionally, the at least one movable jaw includes, separate from each other, a first movable jaw and a second movable jaw;

the first movable jaw comprises a first camshaft, a first grip and a third movable die, the first camshaft nested with and fixed to the third movable die along the longitudinal axis of the vise body, the first grip connected to the first camshaft;

the second movable jaw comprises a second camshaft, a second grip and a fourth movable die, the second camshaft nested with and fixed to the fourth movable die along the longitudinal axis of the vise body, the second grip connected to the second camshaft;

the force applying means comprises the first grip in the first movable jaw and the second grip in the second movable jaw;

the first camshaft is provided thereunder with a first locking block, the first locking block in slidable contact at its bottom surface with the top surface of the vise body;

the second camshaft is provided thereunder with a second locking block, the second locking block in slidable contact at its bottom surface with the top surface of the vise body.

Optionally, the bottom surfaces of the first locking block and the second locking block are respectively fixedly connected to locking gaskets, two of the locking gaskets in slidable contact at their bottom surfaces with the surface of the vise body.

Optionally, the third movable die is snap connected at an external end thereof along the longitudinal axis of the vise body to a third die pad, the fourth movable die is snap connected at an external end thereof along the longitudinal axis of the vise body to a fourth die pad, surfaces of the third movable die and the fourth movable die are respectively fixedly connected to limiting ribs.

Optionally, the vise body is provided, on both sides along its longitudinal axis, with slide bracket rails, the first camshaft and the third movable die are both provided at their bottom surfaces with slide brackets in cooperation with the slide bracket rails of the vise body, the second camshaft and the fourth movable die are both provided at their bottom surfaces with slide brackets in cooperation with the slide bracket rails of the vise body.

Optionally, the first movable jaw further comprises a first pin shaft; the second movable jaw further comprises a second pin shaft;

the first grip is fixedly connected to the first pin shaft, a surface of the first pin shaft is sleeved by a surface of a protruding shaft at one end of the first camshaft;

the second grip is fixedly connected to the second pin shaft, a surface of the second pin shaft is sleeved by a surface of a protruding shaft at one end of the second camshaft.

Optionally, the first camshaft and the second camshaft have the same structure, the first camshaft and the second camshaft define first cams at the middle and second cams on both sides, the first cams raised over the second cams;

a surface of the first cam of the first camshaft contacts a top surface of the first locking block, a surface of the second cam of the first camshaft contacts a die thrust surface of the third movable die;

a surface of the first cam of the second camshaft contacts a top surface of the second locking block, a surface of the second cam of the second camshaft contacts a die thrust surface of the fourth movable die.

Beneficial Effects:

When the movable jaw is fixed to the top surface of the vise body, a force applied to the force applying means is always parallel to the rails, i.e., forward or backward along the longitudinal axis of the vise body. Therefore, there is no problem that may cause a workpiece deviation from a straight line direction of the rails. This can avoid the problem of an angle of clamping deviation and enables the movable jaw to be more firmly fixed to the top surface of the vise body.

Moreover, the first jaw and the first movable die can clamp a workpiece therebetween, and the second jaw and the second movable die can clamp another workpiece therebetween. In this way, workpiece clamping on both sides can be achieved.

Through pressing the movable jaw against the surface of the vise body by the force applying means, the movable jaw can be more firmly fixed in position.

Further, after an operator properly places a workpiece, simply by pushing the force applying means, clamping of the workpiece can be achieved. Therefore, the operation is simple and convenient.

Below, the concept, structural details and resulting technical effects of this application will be further described with reference to the accompanying drawings to provide a full understanding of the objects, features and effects of this application.

DETAILED DESCRIPTION OF THE PREFERRED EMBODIMENTS

Figure 1:
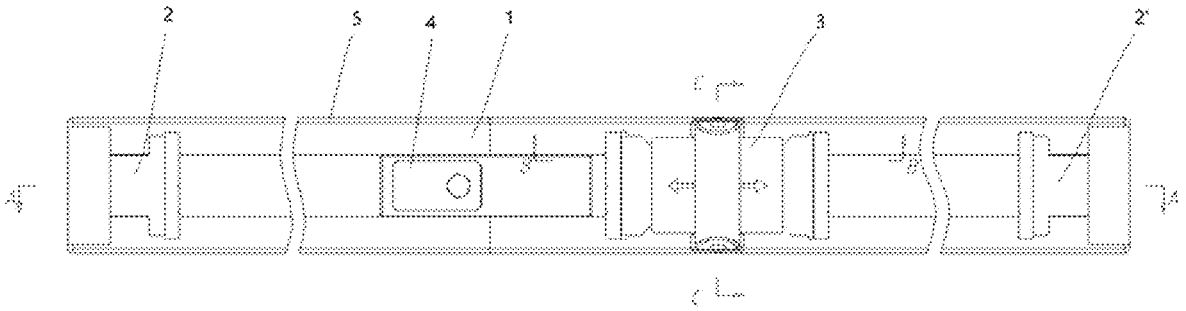
FIG. 1 is a schematic diagram of a woodworking vise provided in an embodiment of the present application.

Below, the drawings accompanying this specification are referenced to introduce many preferred embodiments of the present application so that the techniques disclosed herein become more apparent and better understood. The present application may be embodied in many different forms of embodiment, and the protection scope of the present application is not limited only to the embodiments mentioned herein.

Throughout the accompanying drawings, structurally identical parts are indicated with identical reference numerals, and structurally or functionally similar components are indicated with similar reference numerals. The size and thickness of each component in the drawings are arbitrarily depicted, and the present application is not limited to any size or thickness of each component. For greater clarity of illustration, the thicknesses of some parts are exaggerated as appropriate somewhere in the drawings.

As shown in FIG. 1, a schematic diagram showing the structure of a woodworking vise of an embodiment of the present application, the woodworking vise includes a profiled vise body 1, a first jaw 2, a second jaw 2' and a movable jaw 3. Wherein, the profiled vise body 1 is provided, along its longitudinal axis, with channel rails 5. For example, the profiled vise body 1 is provided, on both sides along its longitudinal axis, with the channel rails 5. The first jaw 2 and the second jaw 2' are disposed at both ends of the profiled vise body 1 and serve as stop elements at both ends of the channel rails 5. The movable jaw 3 can slide along the channel rails 5 forth and back and can be movably fixed to the channel rails 5.

In another embodiment of the present application, in order to be able to clamp large workpieces and shorten a length of the woodworking vise when out of use, the profiled vise body 1 may include two separable vise body segments and a connecting member 4 connecting the two vise body segments together. The two vise body segments may be nested together, with one being partially overlapped or superimposed with the other. When the woodworking vise needs to handle a profile with a relatively long length, at least one of the two vise body segments may be pulled along the longitudinal axis of the profiled vise body 1 so that it is resized to become compatible with the size of the workpiece. The two vise body segments are then secured with the connecting member 4. The connecting member 4 may be a rivet, a screw or a bolt, thus being able to satisfy the needs of profiles of different lengths.

In another embodiment of the present application, at least one of the first jaw 2 and the second jaw 2' is movably fixed to the profiled vise body 1, for example, by a screw or a bolt.

In another embodiment of the present application, at least one of the first jaw 2 and the second jaw 2' is a fixed jaw, for example, fixed to the profiled vise body 1 by bolting, screwing or welding.

In another embodiment of the present application, when a workpiece is placed on the profiled vise body 1, the movable jaw 3 may be pushed to slide along the channel rails 5 so that the workpiece is clamped between one of the first jaw 2 and the second jaw 2' and the movable jaw 3. The movable jaw 3 is then fixed to the profiled vise body 1. After the fixation, an operator can work on the workpiece.

In another embodiment of the present application, there are two of the movable jaws 3, which form workpiece-clamping structures respectively with the first jaw 2 and the second jaw 2'. The two movable jaws 3 have the same structure. For ease of description, the following embodiments are described in the context of one movable jaw 3 as an example.

Therefore, since the woodworking vise of the present embodiment is provided with the movable jaw 3 and the channel rails 5, the woodworking vise can be used to clamp workpieces of different sizes and can simultaneously clamp two workpieces at both ends. The operation is simple and convenient.

Figure 2:
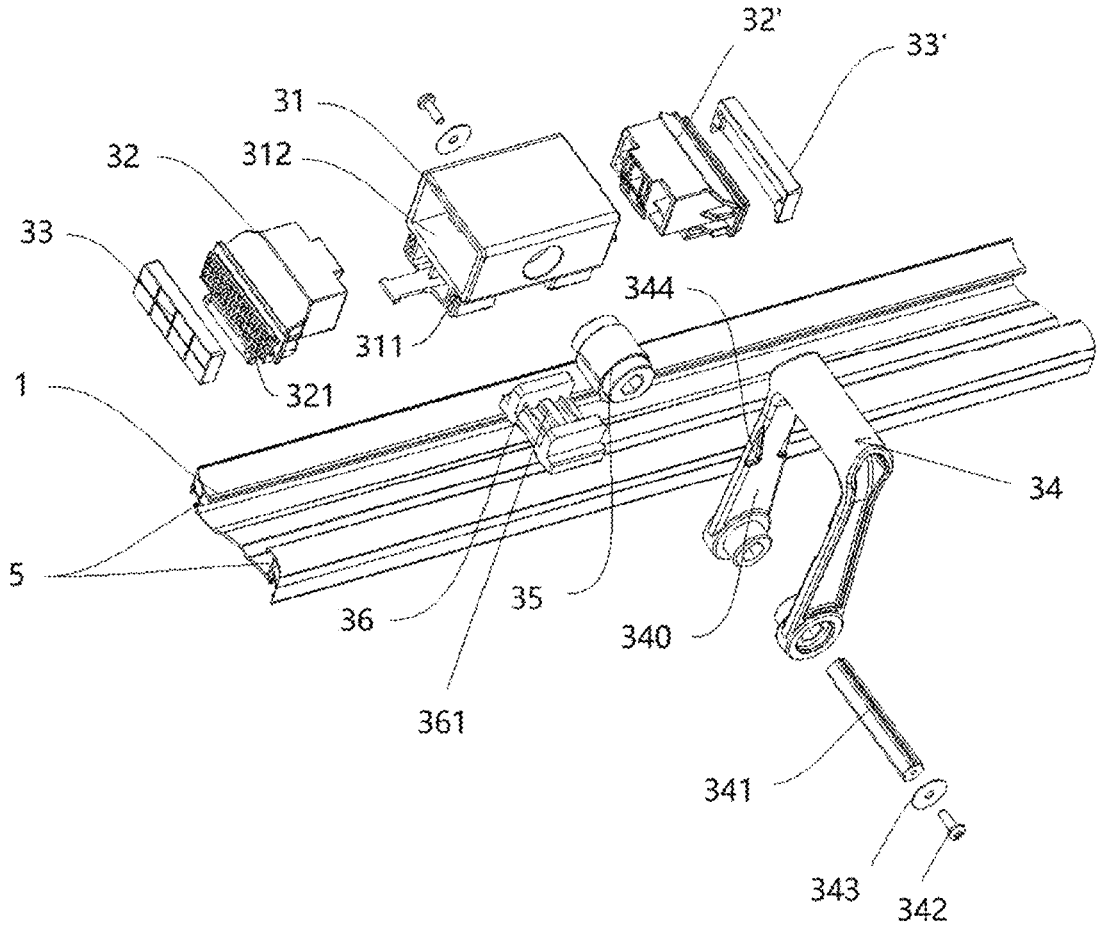
FIG. 2 is a schematic exploded view of the structure of a movable jaw of FIG. 1 in a woodworking vise provided in an embodiment of this application.

In another embodiment of the present application, the movable jaw 3 in the woodworking vise may be structured as shown in FIG. 2, an exploded diagram schematically illustrating the structure of the movable jaw in the woodworking vise of FIG. 1.

The movable jaw 3 includes a die fixing frame 31, a first movable die 32, a second movable die 32', a first die pad 33, a second die pad 33', a force applying means 34, a camshaft 35 and a locking block 36. The force applying means 34 includes a grip 340, a shaft 341 and fasteners 342.

The profiled vise body 1 assumes an elongate shape, and an elongate direction of the profiled vise body 1 is just the aforementioned longitudinal axis of the profiled vise body 1. The profiled vise body 1 is provided, on both sides along its longitudinal axis, with the channel rails 5 that protrude upward. That is, the longitudinal axis of the profiled vise body 1 is parallel to the channel rails 5, and being along the longitudinal axis of the profiled vise body 1 can be also referred to as being along the channel rails 5.

In another embodiment of the present application, the movable jaw 3 is provided with limiting ribs and the force applying means 34 has limiting grooves that cooperate with the limiting ribs to rotate the force applying means 34 to a predetermined position.

In another embodiment of the present application, the channel rails 5 are T-shaped or inverted L-shaped. For example, the profiled vise body 1 is integrally formed with the channel rails 5.

The first movable die 32 and the second movable die 32' are respectively connected to both ends of the die fixing frame 31 along the longitudinal axis of the profiled vise body 1. The first die pad 33 and the second die pad 33' are connected to outermost ends of the first movable die 32 and the second movable die 32' along the longitudinal axis of the profiled vise body 1, respectively. The first movable die 32, the second movable die 32', the first die pad 33 and the second die pad 33' are disposed, after being assembled together, on the channel rails 5 of the profiled vise body 1 such as to be able to slide forth and back along the channel rails 5.

A top surface of the locking block 36 is a fastening abutment surface 361, and the locking block 36 is disposed on a bottom surface of the die fixing frame 31 and can be brought into contact with a top surface of the profiled vise body 1. The camshaft 35 is disposed inside the die fixing frame 31 and arranged on the locking block 36. Moreover, a center axis of the camshaft 35 is perpendicular to the channel rails 5. The force applying means 34 is connected to the camshaft 35 and can rotate about the center axis of the camshaft 35 to cause the camshaft 35 to rotate. Upon the rotation of the camshaft 35 resulting in a cam of the camshaft 35 pressing against the top surface of the locking block 36 and thus firmly pressing the locking block 36 against the top surface of the profiled vise body 1, the movable jaw 3 is fixed to the top surface of the profiled vise body 1.

As can be seen from the above description, when the movable jaw 3 is being fixed to the top surface of the profiled vise body 1, a force exerted on the force applying means 34 is always parallel to the channel rails 5. Therefore, there is no problem that may cause a workpiece deviation from a straight line direction of the rails. This can avoid the problem of an angle of clamping deviation and enables the movable jaw 3 to be more firmly fixed to the top surface of the vise body 1.

Figure 3:
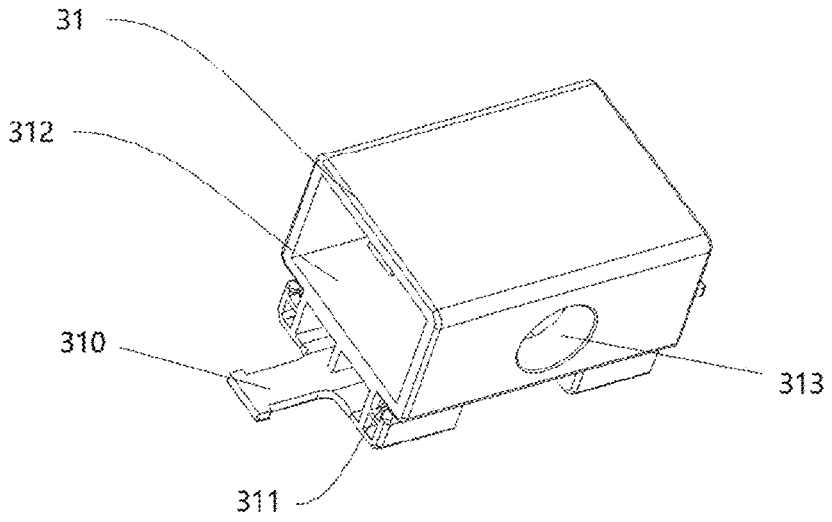
FIG. 3 is a schematic stereoscopic view of the structure of a die fixing frame in the woodworking vise of FIG. 2.

The die fixing frame 31 may be structured as shown in FIG. 3, a diagram schematically illustrating the structure of the die fixing frame in the woodworking vise of FIG. 2. The bottom surface of the die fixing frame 31 is provided thereon, on both sides along the longitudinal axis of the profiled vise body 1, with first slide brackets 311 in cooperation with the channel rails 5. For example, the bottom surface of the die fixing frame 31 is provided thereon, on both sides along the longitudinal axis of the profiled vise body 1, with slide plates 310, and the slide plates 310 project upward on both sides along the longitudinal axis of the profiled vise body 1, forming the first slide brackets 311. The die fixing frame 31 is provided, at both end along the longitudinal axis of the profiled vise body 1, with two openings 312, and the die fixing frame 31 is provided, on both side faces along the longitudinal axis of the profiled vise body 1, with securing holes 313. That is, a line connecting the two securing holes 313 is perpendicular to the longitudinal axis of the profiled vise body 1.

The first movable die 32 and the second movable die 32' have the same structure, and the first die pad 33 and the second die pad 33' have the same structure. The first die pad 33 is engaged with the first movable die 32 in the same manner as the second die pad 33' is engaged with the second movable die 32'. For the brevity of description, the structures of the first movable die 32 and the first die pad 33 and their method of engagement are explained below, as an example.

Figure 4:
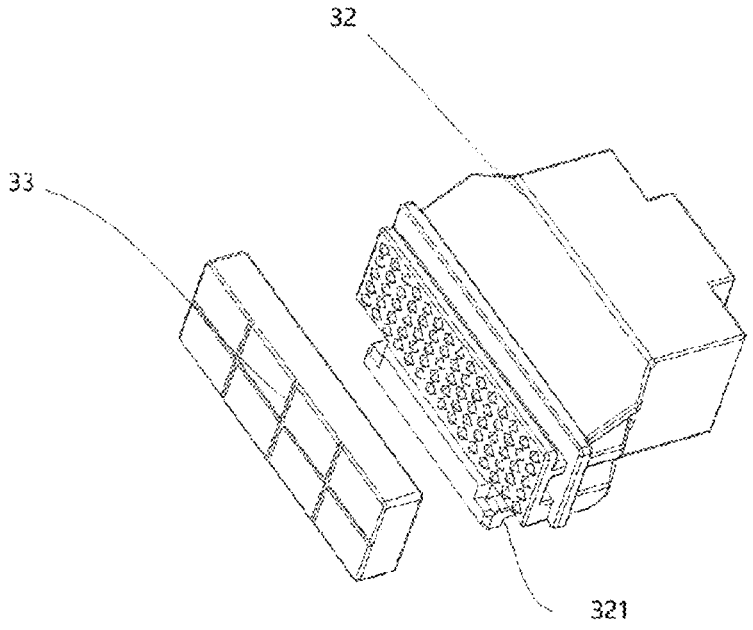
FIG. 4 is a schematic diagram showing the structures of a first movable die and a first die pad in the woodworking vise of FIG. 2, as viewed from one direction.
Figure 5:
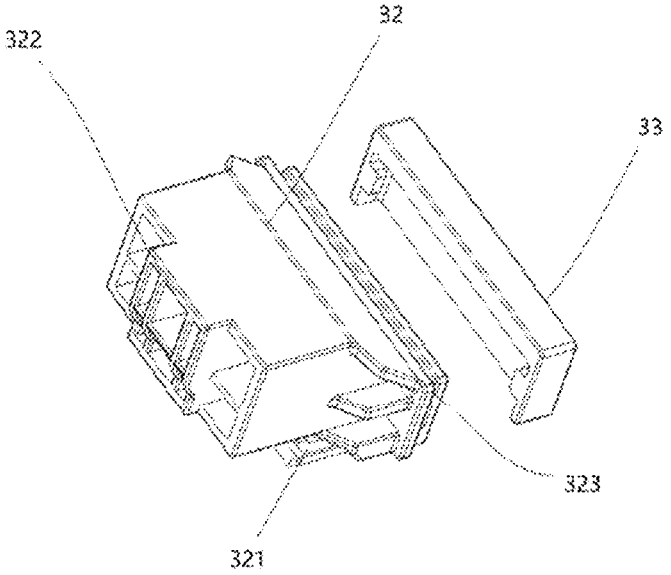
FIG. 5 is a schematic diagram showing the structures of the first movable die and the first die pad in the woodworking vise of FIG. 2, as viewed from another direction.

As shown in FIGS. 4 and 5, schematic structural views of the first movable die and the first die pad in the woodworking vise of FIG. 2 from two different directions, one end of the first movable die 32 is engaged with the first die pad 33, and the other end of the first movable die 32 is engaged with the die fixing frame 31. For example, the other end of the first movable die 32 is inserted into the opening 312 at its one end of the die fixing frame 31 and is fixedly engaged with the opening 312, e.g., by a tight press fit.

An end side face of the first movable die 32 where it is connected to the die fixing frame 31 is a die thrust surface 322, and a limiting rib 323 is provided at a location of engagement of the first movable die 32 with the first die pad 33.

On a bottom surface of the first movable die 32, on both sides along the longitudinal axis of the profiled vise body 1, second slide brackets 321 in cooperation with the channel rails 5 are provided. The second slide brackets 321 are structured and formed in the same manner as the first slide brackets 311 on the bottom surface of the die fixing frame 31 and, therefore, need not be described in further detail herein.

The force applying means 34 includes a grip 340, a shaft 341 and fasteners 342. Wherein, the fasteners 342 are pins, screws or bolts. The grip 340 may be n-shaped, inverted L-shaped or linearly-shaped, and the grip 340 has, at its lower portions, shaft holes in cooperation with the shaft 341. For example, the shaft 341 is inserted along a center axis of the camshaft 35 and fixed to the camshaft 35, and is then fixed to the grip 340. For example, the shaft 341 is a non-circular shaft. For example, the shaft 341 and the shaft holes are both cross-sectionally quadrilateral, e.g., square, in shape. The shaft 341 may be passed through the shaft holes in the lower portions of the grip 340, and the grip 340 may fixed to the shaft 341 by the fasteners 342. In another embodiment of the present application, the force applying means 34 further includes gaskets 343. After the gaskets 343 are disposed over the shaft 341, the grip 340 is fixed to the shaft 341 by the fasteners 342.

Figure 6:
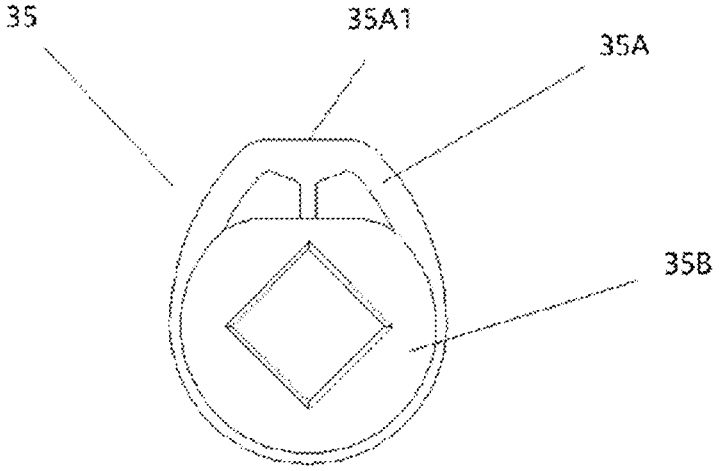
FIG. 6 is a schematic cross-sectional view of the structure of a camshaft in the woodworking vise of FIG. 2.
Figure 7:
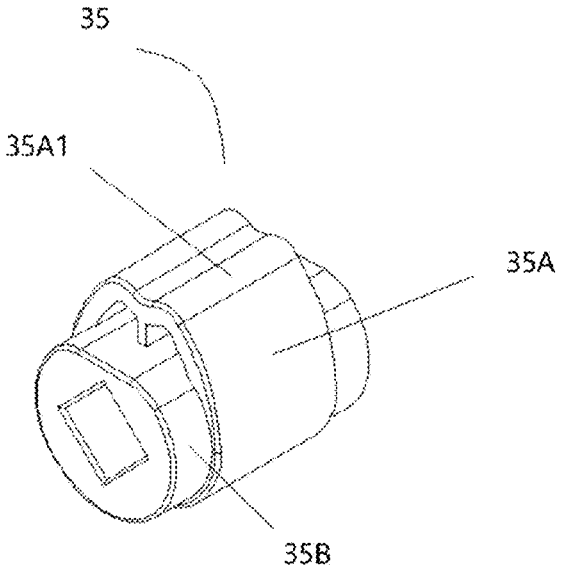
FIG. 7 is a schematic stereoscopic view of the structure of the camshaft in the woodworking vise of FIG. 2.

The camshaft 35 may be a non-circular camshaft having at least one cam, e.g., one cam, two cams or three cams. The cam has a fixation surface at the top. The fixation surface is in cooperation with the surface of the locking block 36. For example, the fixation surface and the surface of the locking block 36 are wavy surfaces in cooperation with each other. The present embodiment is described with the camshaft 35 having two cams as an example. That is, the camshaft 35 is a double camshaft. The camshaft 35 may be structured as shown in FIGS. 6 and 7. The camshaft 35 is a double camshaft 35. The camshaft 35 defines a first cam 35A at the middle and a second cam 35B at both sides. The first cam 35A is raised over the second cam 35B. The first cam 35A has a fixation surface 35A1 at the top. The fixation surface 35A1 may be a curved fixation surface.

Figure 8:
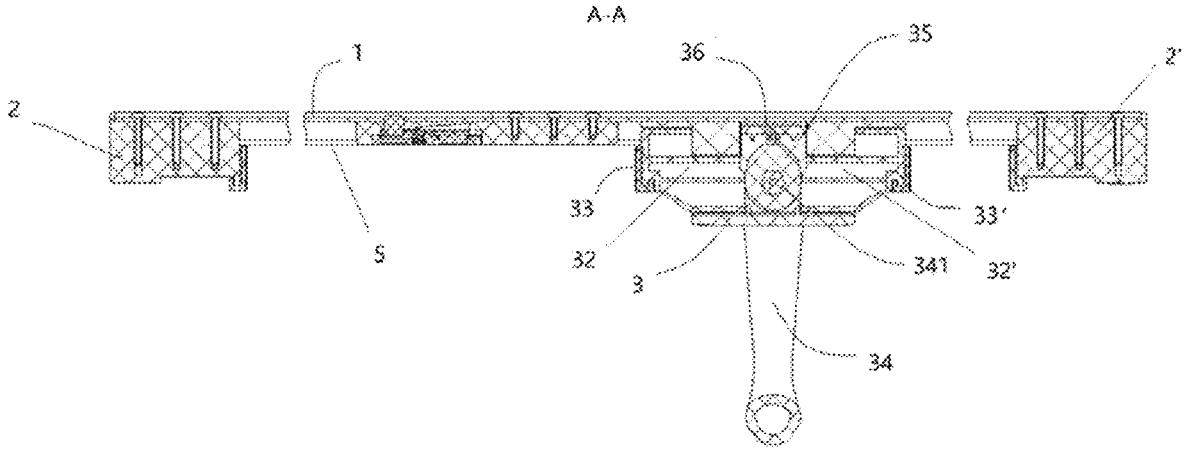
FIG. 8 is a cutaway view of a woodworking vise proposed in an embodiment of this application along direction A-A in FIG. 1.
Figure 9:
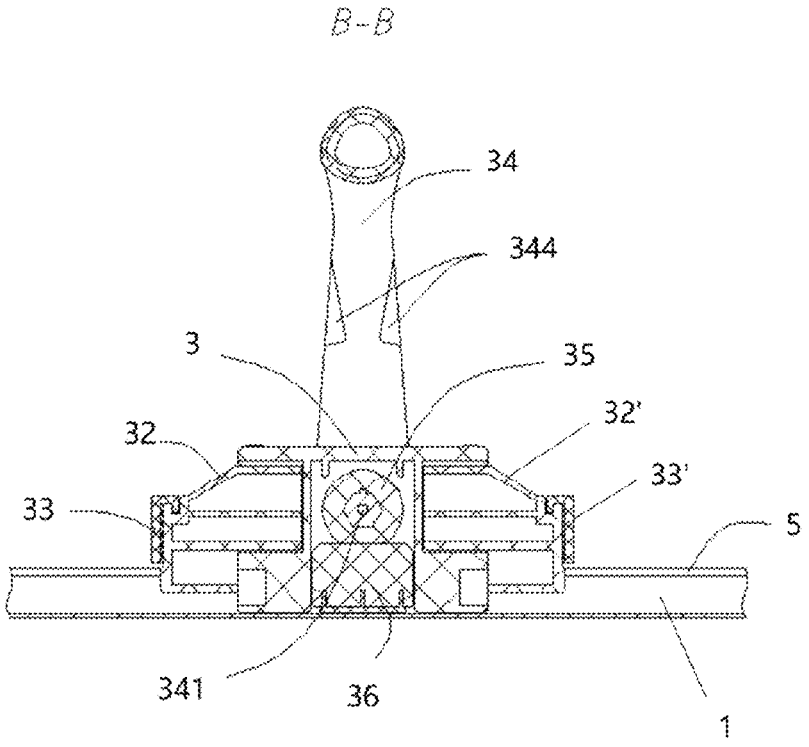
FIG. 9 is a cutaway view of a woodworking vise proposed in an embodiment of this application along direction B-B in FIG. 1.
Figure 10:
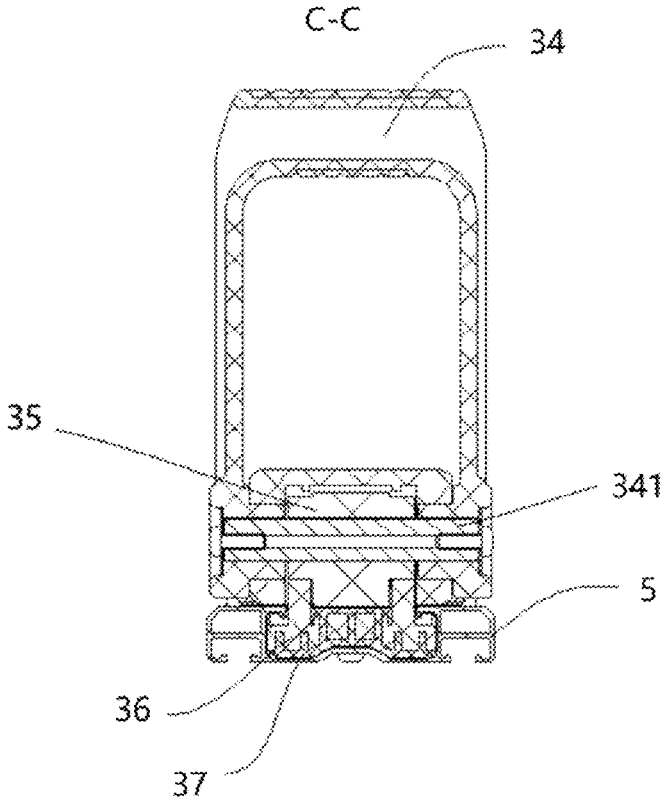
FIG. 10 is a schematic illustration of a woodworking vise proposed in an embodiment of this application along direction C-C in FIG. 1.

The movable jaw 3 may be connected to the profiled vise body 1 in a manner as shown in FIGS. 8 to 10, taken in conjunction with FIG. 2, and as essentially described below.

The first movable die 32 and the second movable die 32' are respectively connected to both ends of the die fixing frame 31 along the longitudinal axis of the profiled vise body 1. For example, they may be respectively inserted into the two openings 312 of the die fixing frame 31 at both ends along the longitudinal axis of the profiled vise body 1. The first die pad 33 and the second die pad 33' are snap connected to the outermost ends of the first movable die 32 and the second movable die 32' along the longitudinal axis of the profiled vise body 1, respectively.

In the bottom surface of the die fixing frame 31, a concave recess is provided. This concave recess is capable of accommodating the camshaft 35. The locking block 36 is placed under the camshaft 35 and on the top surface of the profiled vise body 1.

The center axis of the camshaft 35 is perpendicular to the longitudinal axis of the profiled vise body 1, i.e., to the channel rails 5. The grip 340 of the force applying means 34 is disposed on either one side or both sides of the center axis of the camshaft 35. The grip 340 of the force applying means 34 is inserted, along the center axis of the camshaft 35, first through the shaft holes in the lower portions of the grip 340 and then through the securing holes 313 in both side walls of the die fixing frame 31 along the longitudinal axis of the profiled vise body 1, and the force applying means 34 is then fixed to the die fixing frame 31 using the fasteners 342 in the force applying means 34.

End side faces of the first movable die 32 and the second movable die 32' where they are inserted into the die fixing frame 31 are die thrust surfaces. Surfaces of the first cam 35A may be brought into contact with the respective die thrust surfaces of the first movable die 32 and the second movable die 32', with a surface of the second cam 35B being brought into contact with the top surface of the locking block 36. The shaft 341 is secured at both ends to the force applying means 34 by the fasteners 342, and limiting grooves 344 are provided in surfaces of the force applying means 34. The two limiting grooves 344 are arranged in symmetry with respect to an axis of the force applying means 34.

By bringing the first cam 35A into contact respectively with the die thrust surfaces of the first movable die 32 and the second movable die 32', the first movable die 32 or the second movable die 32' can be pushed to move.

On both sides of the camshaft 35 are the second cam 35B. During rotation of the camshaft 35, the second cam 35B comes into contact with and presses against the locking block 36, achieving fixation of the first movable die 32 and the second movable die 32'.

Figure 11:
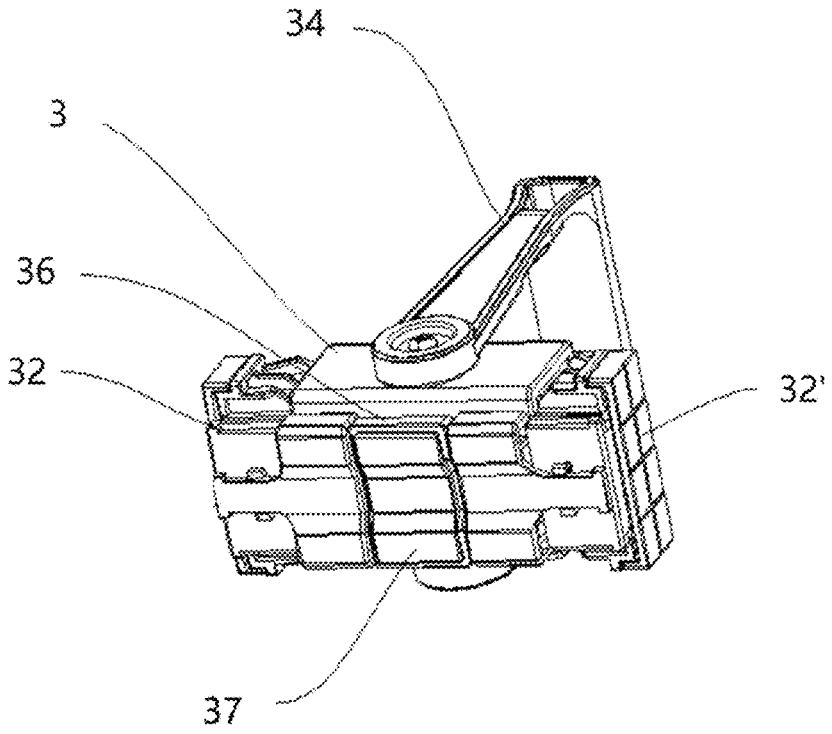
FIG. 11 is partial view of the movable jaw of FIG. 1 in a woodworking vise proposed in an embodiment of this application.

In another embodiment of the present application, as shown in FIG. 11, the locking block 36 is provided at the bottom a locking gasket 37, which can effectively increase friction between the locking block 36 and the top surface of the profiled vise body 1.

For example, the locking block 36 is slidably connected to the bottom surface of the die fixing frame 31, and a top surface of the locking block 36 extends within the die fixing frame 3. The locking block 36 is slidably connected at both sides to the channel rails 5 of the profiled vise body 1, and the locking gasket 37 is fixedly connected to the bottom surface of the locking block 36. A bottom surface of the locking gasket 37 is slidably connected to the top surface of the profiled vise body 1, and both ends of the die fixing frame 31 are slidably connected to the first movable die 32 and the second movable die 32'. For example, the first movable die 32 or the second movable die 32' is symmetrical with respect to an axis of the die fixing frame 31. On surfaces of the first movable die 32 and the second movable die 32' and a surface of the die fixing frame 3, slide brackets are provided. The slide brackets are adapted to the channel rails 5 of the profiled vise body 1, and the first die pad 33 and the second die pad 33' are snap connected to the first movable die 32 and the second movable die 32', respectively. Limiting ribs 323 are fixedly connected to the first movable die 32 and the second movable die 32'. The limiting ribs 323 can not only stop the surface of the die fixing frame 31, but can also stop the grip 340. That is, the limiting ribs 323 work together with the limiting grooves 344 to limit the grip 340.

The camshaft 35 is caused to rotate by rotation of the shaft 341, and the shaft 341 is connected to the force applying means 34. As such, by pulling the force applying means 34, the camshaft 35 can be rotated to push the first movable die 32 or the second movable die 32', thus firmly clamping a workpiece between the first jaw 2 and the first movable die 32, or firmly clamping a workpiece between the second jaw 2' and the second movable die 32'.

In another embodiment of the present application, the first cam 35A of the camshaft 35 has a fixation surface 35A1, and when it is rotated to an appropriate position, the first cam 35A cooperates with the fastening abutment surface 361 of the locking block 36 for fixation. For example, the fixation surface 35A1 and the fastening abutment surface 361 are curved fixation surfaces that can engage each other.

In another embodiment of the present application, as shown in FIG. 2, the first movable die 32 and the second movable die 32' are both provided at one side with a limiting rib 323. The limiting rib 323 cooperates with the limiting groove 344 of the force applying means 34. When the force applying means 34 is pulled to a certain position, the limiting groove 344 cooperates with the limiting rib 323 to fix the position of the force applying means 34 without overrotation. This also enables the force applying means 34 to be maintained at a certain height over the top surface of the profiled vise body 1, allowing the force applying means 34 to be gripped by a hand.

As can be seen from the above description, when the movable jaw 3 is being fixed to the top surface of the profiled vise body 1, a force exerted on the force applying means 34 is always parallel to the channel rails 5. Therefore, there is no problem that may cause a workpiece deviation from a straight line direction of the rails. This can avoid the problem of an angle of clamping deviation and enables the movable jaw 3 to be more firmly fixed to the top surface of the vise body 1.

Moreover, the first jaw and the first movable die can clamp a workpiece therebetween, and the second jaw and the second movable die can clamp another workpiece therebetween. In this way, workpiece clamping on both sides can be achieved.

Pressing the movable jaw against the surface of the profiled vise body 1 by the force applying means 34 enables the movable jaw 3 to be more firmly fixed in position.

Further, after an operator properly places a workpiece, simply by pushing the force applying means, clamping of the workpiece can be achieved. Therefore, the operation is simple and convenient.

Figure 12:
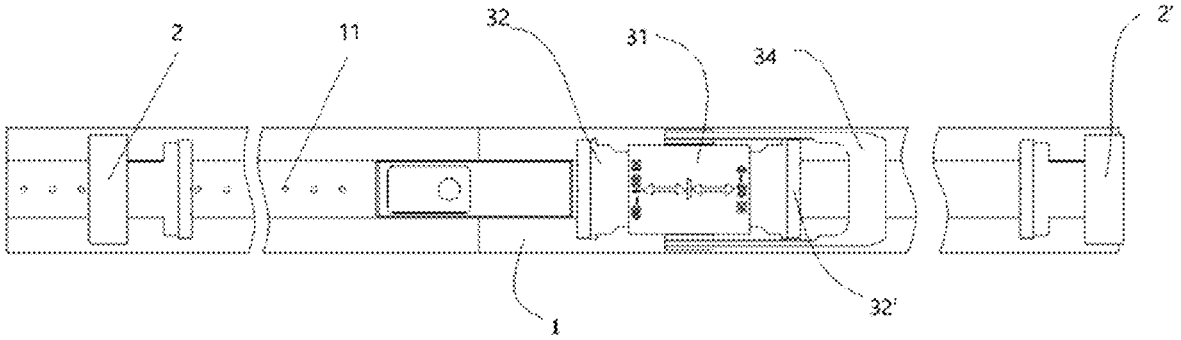
FIG. 12 is a schematic diagram showing the structure of a woodworking vise of another embodiment of this application.
Figure 13:
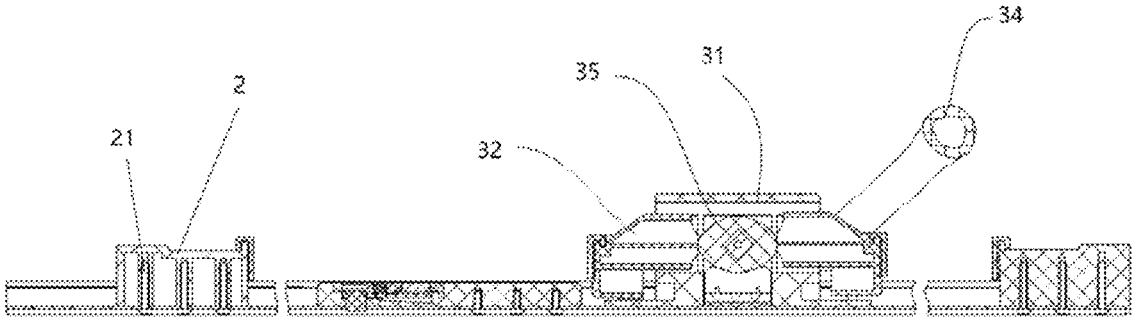
FIG. 13 is a schematic illustration of the woodworking vise of the FIG. 12 in a force applying state.
Figure 14:
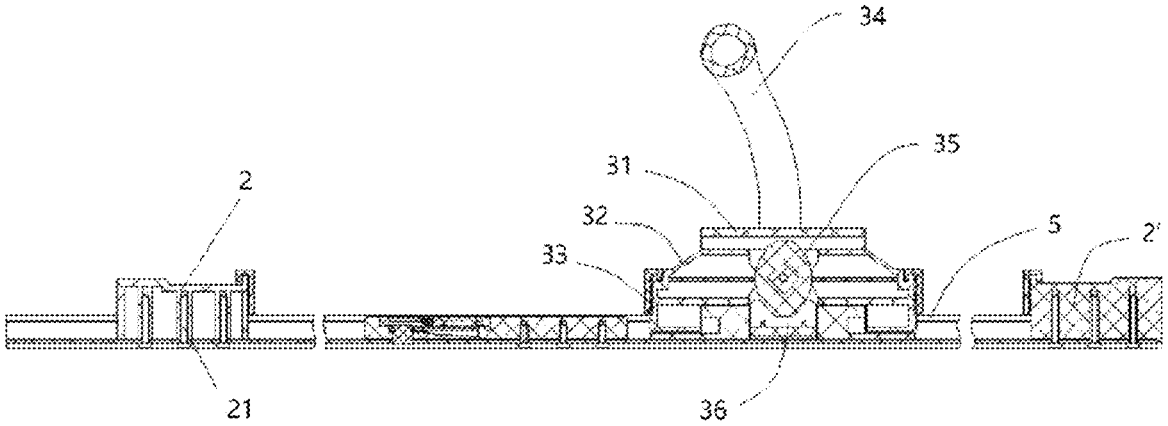
FIG. 14 is a schematic illustration of the woodworking vise of the FIG. 12 not in a force applying state.

In another embodiment of the present application, at least one of the first jaw 2 and the second jaw 2' may be a movable jaw. For example, as shown in FIGS. 12 to 14, taking the first jaw 2 as a movable jaw as an example, description will be made.

The first jaw 2 and the second jaw 2' are disposed at both ends of the profiled vise body 1 along the longitudinal axis, for example, in symmetry. The first jaw 2 is a variable jaw, and the first jaw 2 can be movably fixed to the profiled vise body 1. The fixation may be fixation by a connecting element 21, or other fixation by a button. The second jaw 2' is fixedly connected to the profiled vise body 1 using a screw or by welding.

For example, in correspondence with the first jaw 2, a plurality of coupling holes 11 are arranged on the profiled vise body 1 along the longitudinal axis of the profiled vise body 1. When the first jaw 2 is moved to a predetermined position, the connecting element 21 fixes the first jaw 2 to the coupling hole 11 at the position. That is, the first jaw 2 is fixed at the predetermined position of the profiled vise body 1.

In another embodiment of this application, the connecting element 21 may be a screw or a bolt.

The rest part of the woodworking vise shown in FIGS. 12 to 14 is structured essentially in the same way as that of the woodworking vise described above with respect to FIGS. 1 to 8 and, therefore, needs not be described in further detail here.

Figure 15:
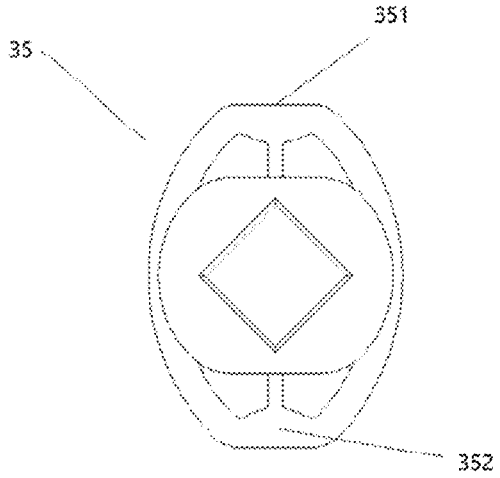
FIG. 15 is a schematic illustration of another double camshaft in a woodworking vise proposed in another embodiment of this application.

In another embodiment of this application, the first cam 35A of the camshaft 35 may also have two fixation surfaces. For example, as shown in FIG. 15, the first cam 35A has a first fixation surface 351 and a second fixation surface 352. The first fixation surface 351 and the second fixation surface 352 may be wavy or curved fixation surfaces. The first fixation surface 351 and the second fixation surface 352 are structured and function in the same way as the fixation surface 35A1 of the first cam 35A described above with respect to FIGS. 1 to 8 and, therefore, need not be described in further detail here.

Accordingly, the top surface of the locking block 36 also have fastening abutment surfaces 361 in cooperation with the fixation surfaces of the first fixation surface 351 and the second fixation surface 352. The fastening abutment surfaces 361 are wavy or curved surfaces.

In another embodiment of the present application, the channel rails 5 engage any of the slide brackets by a snap fit engagement allowing slidability on the channel rail 5. For example, the channel rails 5 have barbed tongues barbed toward the top surface of the profiled vise body 1 or flanges parallel to the profiled vise body 1, and the slide brackets have grooves. The barbed tongues and flanges of the channel rails 5 can be snapped in the grooves.

When a workpiece is placed on the top surface of the profiled vise body 1, the first movable die 32 is moved to clamp the workpiece against the first jaw 2 on one end of the profiled vise body 1, and the grip 340 is pushed along the longitudinal axis of the profiled vise body 1 so that the grip 340 rotates about the center axis of the camshaft 35. The grip 340, by means of the shaft 341 of the camshaft 35, causes the camshaft 35 to rotate. The second cam 35B of the camshaft 35 first bears against the first movable die 32 to firmly press the workpiece between the first jaw 2 and the first movable die 32, and then by the first cam 35A, the locking block 36 is pressed against the top surface of the profiled vise body 1, fixing the movable jaw 3 to the top surface of the profiled vise body 1.

Figure 16:
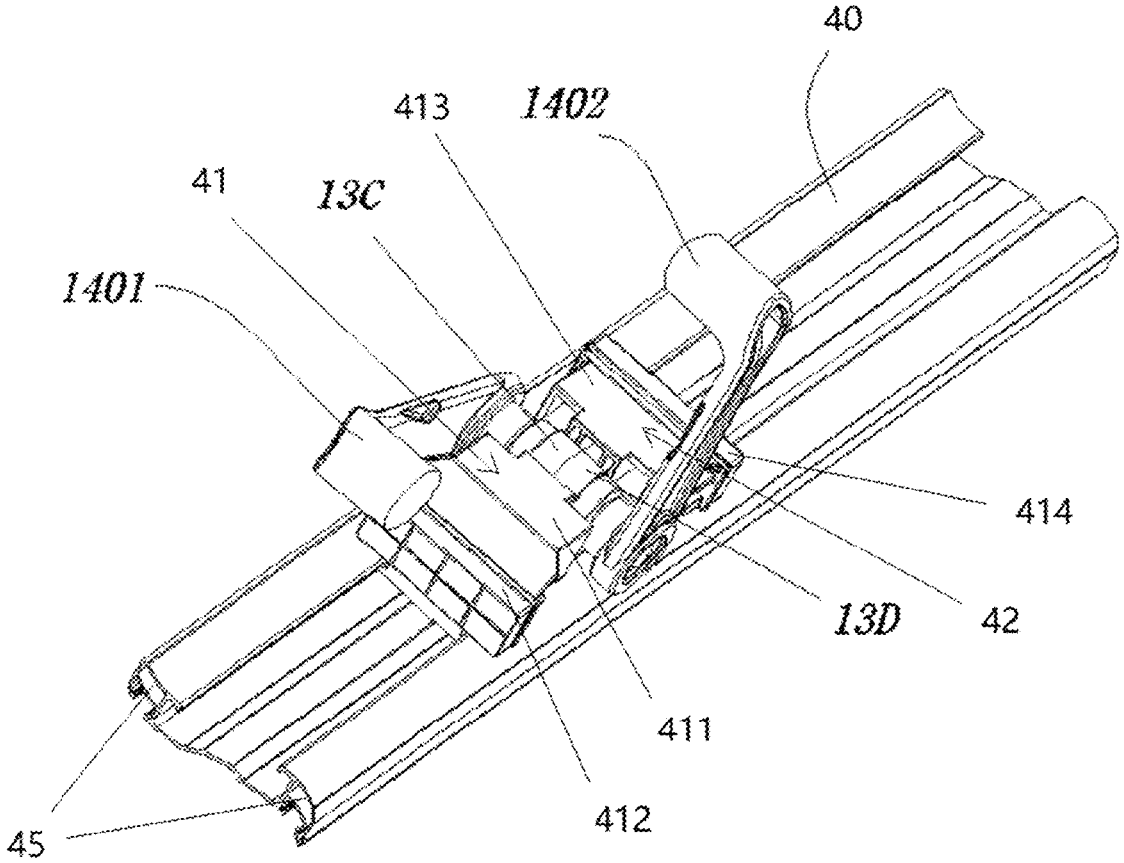
FIG. 16 is a schematic diagram showing the structure of a woodworking vise of another embodiment of the present application.
Figure 17:
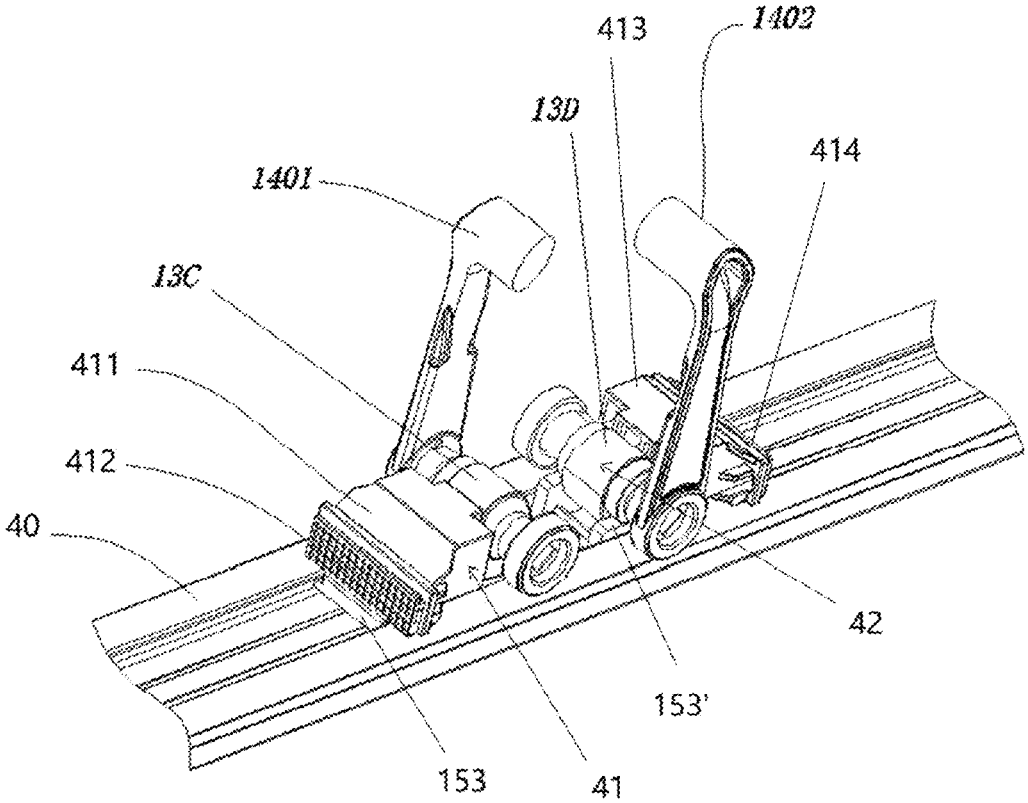
FIG. 17 is a schematic diagram showing the structure of a woodworking vise of another embodiment of the present application.

In another embodiment of this application, as shown in FIGS. 16 to 17, schematic diagrams showing the structure of a woodworking vise of this embodiment of the application, the woodworking vise includes a profiled vise body 40 and two separate movable jaws positioned on a top surface of the profiled vise body 40. The two separate movable jaws include a first movable jaw 41 and a second movable jaw 42.

The first movable jaw 41 and the second movable jaw 42 have identical reciprocal structures. For example, the first movable jaw 41 includes a first camshaft 13C, a first grip 1401, a third movable die 411 and a third die pad 412, and the second movable jaw 42 includes a second camshaft 13D, a second grip 1402, a fourth movable die 413 and a fourth die pad 414. The first grip 1401 of the first movable jaw 41 and the second grip 1402 provided in the second movable jaw 42 make up the force applying means.

The profiled vise body 40 is provided, on both sides of a longitudinal axis thereof, with slide bracket rails 45.

The first camshaft 13C is nested with and fixed to the third movable die 411 along the longitudinal axis of the profiled vise body 40, and the third die pad 412 is snap connected to one side of the third movable die 411 along the longitudinal axis of the profiled vise body 40. The first camshaft 13C and the third movable die 411 are both provided on their bottom surfaces with slide brackets in cooperation with the slide bracket rails 45 of the profiled vise body 40. The slide brackets are structured in the same way as the slide brackets in the embodiment described above with respect to FIGS. 1 to 8 and, therefore, need not be described in further detail here.

The second camshaft 13D is nested with and secured to the fourth movable die 413 along the longitudinal axis of the profiled vise body 40, and the fourth die pad 414 is snap connected to an external end of the fourth movable die 413 along the longitudinal axis of the profiled vise body 40. The second camshaft 13D and the fourth movable die 413 are both provided on their bottom surfaces with slide brackets in cooperation with the slide bracket rails 45 of the profiled vise body 40. The slide brackets are structured in the same way as the slide brackets in the embodiment described above with respect to FIGS. 1 to 8 and, therefore, need not be described in further detail here.

Figure 18:
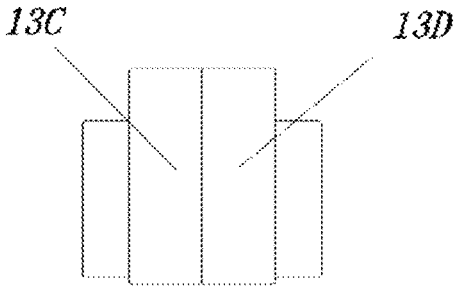
FIG. 18 is a schematic illustration of another double camshaft in a woodworking vise proposed in another embodiment of this application.

As shown in FIG. 18, the first camshaft 13C and the second camshaft 13D have identical reciprocal structures. Their structures may both be the same as that of the camshaft 35 described previously in the above embodiment.

Figure 19:
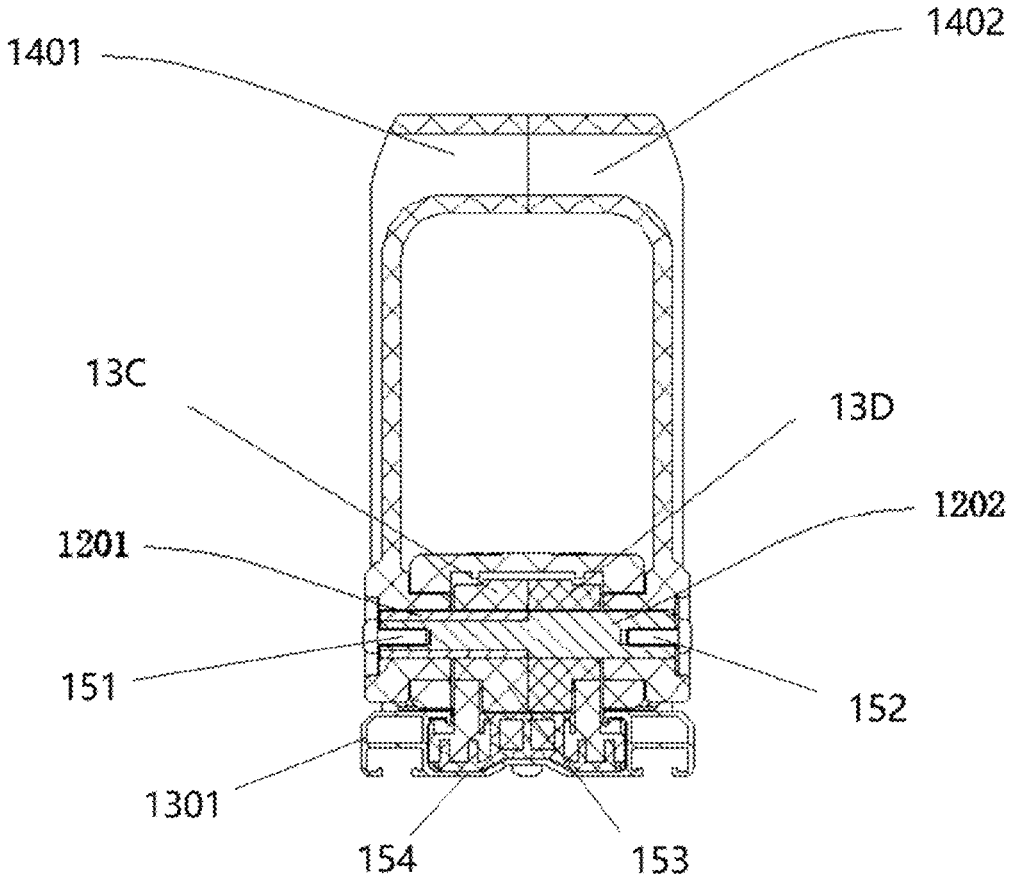
FIG. 19 is a schematic cutaway view of the woodworking vise of FIG. 16.

As shown in FIG. 19, in conjunction with FIGS. 16 and 17, the first grip 1401 may be n-shaped, inverted L-shaped, or linearly shaped. The first grip 1401 is connected to the first camshaft 13C on either side or both sides of a center axis of the first camshaft 13C. The center axis of the first camshaft 13C is perpendicular to the longitudinal axis of the profiled vise body 40.

For example, as shown in FIG. 19, the first camshaft 13C is engaged with the profiled vise body 40 in the same manner in which the camshaft 35 is engaged with the profiled vise body 1 in the embodiment described previously with respect to FIGS. 1 to 8.

For example, the first camshaft 13C is provided thereunder with a first locking block 153. A bottom surface of the first locking block 153 slidably contacts the top surface of the profiled vise body 40, and a surface of the first camshaft 13C contacts a top surface of the first locking block 153. When the first camshaft 13C is rotated, a cam of the first camshaft 13C will come into contact with and then press against the first locking block 153, achieving fixation of the first movable jaw 41.

In another embodiment of the present application, as shown in FIG. 19, the first locking block 153 is provided at the bottom with a locking gasket 154, which effectively increases friction between the first locking block 153 and the top surface of the profiled vise body 40.

For example, the surface of the first camshaft 13C is slidably connected to the first locking block 153, and the top surface of the first locking block 153 extends within the first camshaft 13C. The first locking block 153 is slidably connected on both sides to the profiled vise body 40. The locking gasket 154 is fixedly connected to the bottom surface of the first locking block 153. A bottom surface of the locking gasket 154 is in slidable contact with the surface of the profiled vise body 40.

The first camshaft 13C and the third movable die 411 are both provided on their bottom surfaces with third slide brackets 1301 in cooperation with the slide bracket rails 45 of the profiled vise body 40. The third slide brackets 1301 are adapted to the channel rails 45 on the surface of the profiled vise body 40. The first camshaft 13C is snap connected to the third movable die 411, and a limiting rib is fixedly connected to a surface of the third movable die 411. The limiting rib not only can stop the surface of the first camshaft 13C but also can stop the first grip 1401. As such, the first grip 1401 is limited in position.

The first grip 1401 is fixedly connected to a first pin shaft 1201. For example, the first grip 1401 is fixed to the first pin shaft 1201 by a bolt. A surface of the first pin shaft 1201 is convex. The surface of the first pin shaft 1201 is sleeved by a surface of a protruding shaft at one end of the first camshaft 13C.

In another embodiment of the present application, the first grip 1401 is provided, in a low portion thereof, with a shaft hole in cooperation with a shaft of the first camshaft 13C. The shaft of the first camshaft 13C is a non-circular shaft. For example, the shaft of the first camshaft 13C and the shaft hole are both cross-sectionally quadrilateral, e.g., square, in shape. The shaft of the first camshaft 13C may be passed through the shaft hole in the lower portion of the first grip 1401 and fixedly connected to the first grip 1401 by a fastener. The fastener may be a screw or a bolt. In another embodiment of the present application, after a gasket is disposed over the shaft of the first camshaft 13C, the first grip 1401 may be fixed to the shaft of the first camshaft 13C by the fastener.

When a workpiece is placed on the top surface of the profiled vise body 40, the first movable jaw 41 is moved to clamp the workpiece against a jaw at one end of the profiled vise body 40, and the first grip 1401 is pushed along the longitudinal axis of the profiled vise body 40 so that it rotates about the center axis of the first camshaft 13C. The first grip 1401, by means of the first pin shaft 1201 or the shaft of the first camshaft 13C, causes the first camshaft 13C to rotate. A cam of the first camshaft 13C first bears against the third movable die 411 to firmly press the workpiece between the jaw at the end of the profiled vise body 40 and the third movable die 411 and then presses the first locking block 153 against the top surface of the profiled vise body 40, fixing the first movable jaw 41 to the top surface of the profiled vise body 40.

As shown in FIG. 19, in conjunction with FIGS. 16 and 17, the second grip 1402 may be n-shaped, inverted L-shaped, or linearly shaped. The second grip 1402 is connected to the second camshaft 13D on either side or both sides of a center axis thereof. Wherein, the center axis of the second camshaft 13D is perpendicular to the longitudinal axis of the profiled vise body 40.

For example, as shown in FIG. 19, the second camshaft 13D is engaged with the profiled vise body 40 in the same manner in which the camshaft 35 is engaged with the profiled vise body 1 in the embodiment described previously with respect to FIGS. 1 to 8.

The first camshaft 13C and the second camshaft 13D have the same structure. The first camshaft 13C and the second camshaft 13D both define first cams at the middle and second cams at both sides. The first cams are raised over the second cams. A surface of the first cam of the first camshaft 13C is brought into contact with the top surface of the first locking block 153, and a surface of the second cam of the first camshaft 13C is brought into contact with a die thrust surface of the third movable die 411. A surface of the first cam of the second camshaft 13D is brought into contact with a top surface of a second locking block, and a surface of the second cam of the second camshaft 13D is brought into contact with a die thrust surface of the fourth movable die 413.

For example, a surface of the second camshaft 13D contacts the top surface of the second locking block 153'. When the second camshaft 13D is rotated, the cam of the second camshaft 13D will come into contact with and then press against the second locking block 153', achieving fixation of the position of the first movable jaw 41.

In another embodiment of the present application, the second locking block 153' is provided at the bottom with a locking gasket, which effectively increases friction between the second locking block 153' and the top surface of the profiled vise body 40.

For example, the surface of the second camshaft 13D is slidably connected to the second locking block 153', and the top surface of the second locking block 153' extends within the second camshaft 13D. The second locking block 153' is slidably connected on both sides to the profiled vise body 40. The second locking block 153' is fixedly connected at the bottom surface to the locking gasket, and a surface of the locking gasket is slidably connected to the surface of the profiled vise body 40.

The second camshaft 13D and the fourth movable die 413 are both provided on their bottom surfaces with third slide brackets 1301 in cooperation with the slide bracket rails 45 of the profiled vise body 40. The third slide brackets 1301 are adapted to the channel rails 45 on the surface of the profiled vise body 40. The second camshaft 13D is snap connected to the fourth movable die 413, and a limiting rib is fixedly connected to a surface of the fourth movable die 413. The limiting rib not only can stop the surface of the second camshaft 13D, but also can stop the second grip 1402. As such, the second grip 1402 is limited in position.

In another embodiment of the present application, the channel rails 45 engage the third slide brackets 1301 by snap fit engagement allowing slidability on the channel rails 45. For example, the channel rails 45 have barbed tongues barbed toward the top surface of the profiled vise body 40 or flanges parallel to the profiled vise body 40, and the third slide brackets 1301 have grooves in which the barbed tongues and flanges of the channel rails 45 can be snapped.

The second grip 1402 is fixedly connected to a second pin shaft 1202. For example, the second grip 1402 is fixed to the second pin shaft 1202 by a bolt. The second pin shaft 1202 has a convex surface which is sleeved by a surface of a protruding shaft at one end of the second camshaft 13D.

In another embodiment of the present application, the second grip 1402 defines, in a low portion thereof, a shaft hole in cooperation with a shaft of the second camshaft 13D. The shaft of the second camshaft 13D is a non-circular shaft. For example, the shaft of the second camshaft 13D and the shaft hole are both cross-sectionally quadrilateral, e.g., square, in shape. The shaft of the second camshaft 13D may be passed through the shaft hole in the lower portion of the second grip 1402 and fixedly connected to the second grip 1402 by a fastener. The fastener may be a screw or a bolt. In another embodiment of the present application, after a gasket is disposed over the shaft of the second camshaft 13D, the second grip 1402 may be fixed to the shaft of the second camshaft 13D by the fastener.

When a workpiece is placed on the top surface of the profiled vise body 40, the first movable jaw 41 is moved to clamp the workpiece against a jaw at one end of the profiled vise body 40, and the second grip 1402 is pushed along the longitudinal axis of the profiled vise body 40 so that it rotates about the center axis of the second camshaft 13D. The second grip 1402, by means of the second pin shaft 1202 or the shaft of the second camshaft 13D, causes the second camshaft 13D to rotate. A cam of the second camshaft 13D first bears against the fourth movable die 413 to firmly press the workpiece between the jaw at the end of the profiled vise body 40 and the fourth movable die 413 and then presses the second locking block 153' against the top surface of the profiled vise body 40, fixing the first movable jaw 41 to the top surface of the profiled vise body 40.

Preferred specific embodiments have been described in detail above. It is to be understood that, those of ordinary skill in the art, without the need for creative effort, can make various modifications and changes, based on the concept of the present application. Accordingly, all the technical solutions that can be obtained by those skilled in the art by logical analysis, inference or limited experimentation in accordance with the concept of this application on the basis of the prior art are intended to fall within the protection scope of as defined by the claims.

The invention claimed is:

1. A woodworking vise comprising a vise body, a first jaw and a second jaw, wherein the first jaw and the second jaw are disposed at both ends of the vise body along a longitudinal axis thereof, characterized in that, the woodworking vise further comprises at least one movable jaw, the at least one movable jaw slidably connected to the vise body;

between the movable jaw and the vise body, a locking block is disposed the locking block slidably connected to the vise body; and the movable jaw comprises a force applying means and a camshaft, the camshaft having at least one cam, the force applying means connected to the camshaft, the force applying means able to rotate about a center axis of the camshaft to drive the camshaft to rotate therewith to cause the cam of the camshaft to press against the locking block, and by means of the locking block, press and fix the movable jaw against and to the vise body, wherein the center axis of the camshaft is perpendicular to the longitudinal axis of the vise body.

2. The woodworking vise of claim 1, characterized in that, at least one of the first jaw and the second jaw is movably connected to the vise body.

3. The woodworking vise of claim 2, characterized in that, the woodworking vise further comprises at least one connecting member, the vise body is provided with a plurality of coupling holes arranged along the longitudinal axis of the vise body, when the first jaw and/or the second jaw is/are moved to a predetermined position, the connecting member fixes the first jaw and/or the second jaw at the predetermined position by means of the coupling holes.

4. The woodworking vise of claim 1, characterized in that, the vise body is provided along its longitudinal axis with channel rails, the movable jaw is provided with slide brackets in cooperation with the channel rails, the movable jaw is, by virtue of the channel rails and the slide brackets, slidable forth and back on the vise body.

5. The woodworking vise of claim 1, characterized in that, the movable jaw further comprises a die fixing frame, a first movable die and a second movable die, the die fixing frame is provided on both ends along the longitudinal axis of the vise body with openings, the first movable die and the second movable die are respectively inserted into the openings at both ends of the die fixing frame.

6. The woodworking vise of claim 5, characterized in that, the vise body is provided along its longitudinal axis with channel rails, the first movable die and the second movable die are both provided with slide brackets in cooperation with the channel rails.

7. The woodworking vise of claim 5, characterized in that, the at least one cam comprises a first cam and a second cam, and the camshaft defines the first cam at the middle and the second cam on both sides, the first cam raised over the second cam;

the first cam contacts the locking block, the second cam contacts both the first movable die and the second movable die.

8. The woodworking vise of claim 7, characterized in that, the vise body is provided along its longitudinal axis with channel rails, the first movable die and the second movable die are both provided with slide brackets in cooperation with the channel rails.

9. The woodworking vise of claim 5, characterized in that, the first movable die and the second movable die are both provided with limiting ribs, the limiting ribs used to respectively limit the first movable die and the second movable die from complete insertion into the openings of the die fixing frame.

10. The woodworking vise of claim 1, characterized in that, the movable jaw is provided with limiting ribs, the force applying means has limiting grooves cooperating with the limiting ribs to rotate the force applying means to a predetermined position.

11. The woodworking vise of claim 1, characterized in that, the locking block is fixedly connected to a locking gasket, the locking gasket slidably connected to the vise body.

12. The woodworking vise of claim 1, characterized in that, the vise body comprises two separable vise body segments and a connecting member connecting the two vise body segments, the two vise body segments able to be nested together with one being partially overlapped or superimposed with the other.

13. The woodworking vise of claim 1, characterized in that, the at least one movable jaw comprises, separate from each other, a first movable jaw and a second movable jaw;

the first movable jaw comprises a first camshaft, a first grip and a third movable die, the first camshaft nested with and fixed to the third movable die along the longitudinal axis of the vise body, the first grip connected to the first camshaft;

the second movable jaw comprises a second camshaft, a second grip and a fourth movable die, the second camshaft nested with and fixed to the fourth movable die along the longitudinal axis of the vise body, the second grip connected to the second camshaft;

the force applying means comprises the first grip in the first movable jaw and the second grip in the second movable jaw;

the first camshaft is provided thereunder with a first locking block, the first locking block in slidable contact with the vise body;

the second camshaft is provided thereunder with a second locking block, the second locking block in slidable contact with the vise body.

14. The woodworking vise of claim 13, characterized in that, the first locking block and the second locking block are respectively fixedly connected to locking gaskets, two of the locking gaskets in slidable contact with the vise body.

15. The woodworking vise of claim 13, characterized in that, the third movable die is snap connected at an external end thereof along the longitudinal axis of the vise body to a third die pad, the fourth movable die is snap connected at an external end thereof along the longitudinal axis of the vise body to a fourth die pad, surfaces of the third movable die and the fourth movable die are respectively fixedly connected to limiting ribs.

16. The woodworking vise of claim 13, characterized in that, the vise body is provided on both sides along its longitudinal axis with slide bracket rails, the first camshaft and the third movable die both have slide brackets in cooperation with the slide bracket rails of the vise body, the second camshaft and the fourth movable die both have slide brackets in cooperation with the slide bracket rails of the vise body.

* * * * *